US007620344B2

(12) United States Patent
Igarashi

(10) Patent No.: US 7,620,344 B2
(45) Date of Patent: Nov. 17, 2009

(54) IMAGE FORMING APPARATUS, DRAWABLE CARTRIDGE, AND RECORDING MEDIUM ACCOMMODATING CARTRIDGE

(75) Inventor: Hiroshi Igarashi, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 236 days.

(21) Appl. No.: 11/237,720

(22) Filed: Sep. 29, 2005

(65) Prior Publication Data

US 2006/0067732 A1 Mar. 30, 2006

(30) Foreign Application Priority Data

Sep. 29, 2004 (JP) ..... 2004-285073
Oct. 29, 2004 (JP) ..... 2004-317218
Mar. 24, 2005 (JP) ..... 2005-086332

(51) Int. Cl.
*G03G 15/00* (2006.01)

(52) U.S. Cl. ..... 399/110; 399/393

(58) Field of Classification Search ..... 399/110, 399/121, 124, 388, 393
See application file for complete search history.

(56) References Cited

U.S. PATENT DOCUMENTS 4,531,823 A 7/1985 Deguchi et al.
5,216,475 A 6/1993 Ohno
5,461,461 A 10/1995 Harasawa et al.
5,557,384 A 9/1996 Takano et al.
5,559,590 A 9/1996 Arai et al.
5,640,660 A 6/1997 Takano et al.
5,659,843 A 8/1997 Takano et al.
5,666,622 A 9/1997 Harasawa et al.
5,897,241 A 4/1999 Takano et al.
5,903,803 A * 5/1999 Kawai et al. ..... 399/116
5,978,617 A 11/1999 Takano et al.
6,708,011 B2 3/2004 Nomura et al.
6,738,590 B2 5/2004 Okimura et al.
6,922,534 B2 7/2005 Goto et al.
7,242,888 B2 7/2007 Ishii
2003/0103780 A1 6/2003 Hoashi

FOREIGN PATENT DOCUMENTS

JP 53-012335 A 2/1978

(Continued)

OTHER PUBLICATIONS

JP Office Action Nov. 8, 2007, JP Appln. 2004-285073 (see conclse statement).

(Continued)

*Primary Examiner*—David M Gray
*Assistant Examiner*—Joseph S. Wong
(74) *Attorney, Agent, or Firm*—Banner & Witcoff, Ltd

(57) ABSTRACT

An image forming apparatus includes: a case having an opening at one face thereof; and a drawable cartridge drawable through the opening. The drawable cartridge may include a conveying belt configured to convey a recording medium from a side nearer to the opening toward a side away from the opening and a feeding roller system for feeding the recording medium toward the conveying belt. The feeding roller system may be at least partially disposed between the opening and the conveying belt at a position to at least partially overlap with the conveying belt when viewed in a direction from the opening. Additional example features of the invention relate to the drawable cartridge structure, the roller unit, and/or the recording medium accommodating cartridge, e.g., usable in the image forming apparatus described above.

18 Claims, 11 Drawing Sheets

FOREIGN PATENT DOCUMENTS

| | | | |
|---|---|---|---|
| JP | 60-170340 | U | 11/1985 |
| JP | 61-116366 | A | 6/1986 |
| JP | 2-163762 | A | 6/1990 |
| JP | 4-302264 | A | 10/1992 |
| JP | 5-072837 | A | 3/1993 |
| JP | 5-162881 | A | 6/1993 |
| JP | 5229686 | | 9/1993 |
| JP | 5321457 | | 12/1993 |
| JP | 6-183056 | A | 7/1994 |
| JP | 7-304540 | A | 11/1995 |
| JP | 7306603 | | 11/1995 |
| JP | 8069241 | | 3/1996 |
| JP | 8-328449 | A | 12/1996 |
| JP | 9197736 | | 7/1997 |
| JP | 9204083 | | 8/1997 |
| JP | 9-235041 | A | 9/1997 |
| JP | 9-325544 | A | 12/1997 |
| JP | 10-186775 | A | 7/1998 |
| JP | 10-198118 | A | 7/1998 |
| JP | 10194530 | | 7/1998 |
| JP | 11-095520 | A | 4/1999 |
| JP | 11143335 | | 5/1999 |
| JP | 11327246 | | 11/1999 |
| JP | 2001225985 | | 8/2001 |
| JP | 2001228664 | | 8/2001 |
| JP | 2001228722 | | 8/2001 |
| JP | 2001331003 | | 11/2001 |
| JP | 2001-341890 | A | 12/2001 |
| JP | 2001-350307 | A | 12/2001 |
| JP | 2002-108172 | | 4/2002 |
| JP | 2002108172 | A * | 4/2002 |
| JP | 2002139926 | | 5/2002 |
| JP | 2002174940 | | 6/2002 |
| JP | 2002318494 | | 10/2002 |
| JP | 2002-323833 | A | 11/2002 |
| JP | 2003107838 | | 4/2003 |
| JP | 2003131472 | | 5/2003 |
| JP | 2003-195726 | A | 7/2003 |
| JP | 2003248380 | | 9/2003 |
| JP | 2003248381 | | 9/2003 |
| JP | 2003248389 | | 9/2003 |
| JP | 2003280489 | | 10/2003 |
| JP | 2004-109466 | A | 4/2004 |
| JP | 2004-168534 | A | 6/2004 |
| JP | 2004-217331 | A | 8/2004 |
| JP | 2004-272107 | A | 9/2004 |
| JP | 2004-301944 | A | 10/2004 |

OTHER PUBLICATIONS

EP Examination Report dtd Apr. 22, 2008, EP Appln. 05021184.6.
EP Communication and Extended Search Report dtd Mar. 22, 2007, EP Appln. 05021184.6.
CN Office Action dtd Sep. 5, 2008, CN Appln 2005101088985.
JP Office Action dtd Aug. 1, 2009, JP Appln. 2004-317218, partial translation.
Examiner's Opinion mailed Jul. 17, 2009 in Japanese Appeal No. 2008-10104 (Application No. JP2004-285073) and Partial English translation thereof.

* cited by examiner

IMAGE FORMING APPARATUS, DRAWABLE CARTRIDGE, AND RECORDING MEDIUM ACCOMMODATING CARTRIDGE

CROSS REFERENCE TO RELATED APPLICATIONS

This application claims priority from Japanese Patent Application Nos. 2005-086332 filed Mar. 24, 2005, 2004-285073 filed Sep. 29, 2004 and 2004-317218 filed Oct. 29, 2004. The entire content of each of these priority applications is incorporated herein by reference.

TECHNICAL FIELD

The disclosure relates to an image forming apparatus, a drawable cartridge, a roller unit included with the drawable cartridge, and a recording medium accommodating cartridge.

BACKGROUND

Japanese Laid-Open Patent Publication No. 2003-107838 discloses an image forming apparatus in which a belt supported by a plurality of shafts, which are arranged along a horizontal direction, is drawable along the horizontal direction through an opening formed on one face of a case of the image forming apparatus.

Such image forming apparatuses include feeding rollers for feeding sheets accommodated in a cassette disposed below the belt onto the belt from the opening side. It is preferable, in terms of feeding accuracy, that the feeding rollers be disposed near the belt. In the image forming apparatus disclosed in Japanese Laid-Open Patent Publication No. 2003-107838, the feeding rollers are fixed below the belt. In such a structure, the feeding rollers are disposed at positions out of a belt drawing path, so that the belt can be smoothly drawn out from the image forming apparatus along the horizontal direction. However, the size or height of the image forming apparatus in the vertical direction becomes greater. If the feeding rollers are disposed between the opening and the belt, the feeding rollers get in the way when the belt is drawn out from the image forming apparatus. Accordingly, the belt has to be drawn out from the image forming apparatus while bypassing the feeding rollers. Thus, the belt is unsmoothly drawn out from the image forming apparatus.

SUMMARY

At least some example aspects of the present invention provide one or more of an image forming apparatus, a drawable cartridge, a roller unit, and/or a recording medium accommodating cartridge. In at least some example structures, one or more of these elements may be arranged so as to achieve a reduction of the size of the image forming apparatus with respect to a direction perpendicular to a belt drawing direction and/or a smooth drawing of a belt through an opening formed in the image forming apparatus.

BRIEF DESCRIPTION OF THE DRAWINGS

Illustrative example structures in accordance with the present invention will be described in detail with reference to the following figures wherein.

DETAILED DESCRIPTION

Figure 1:
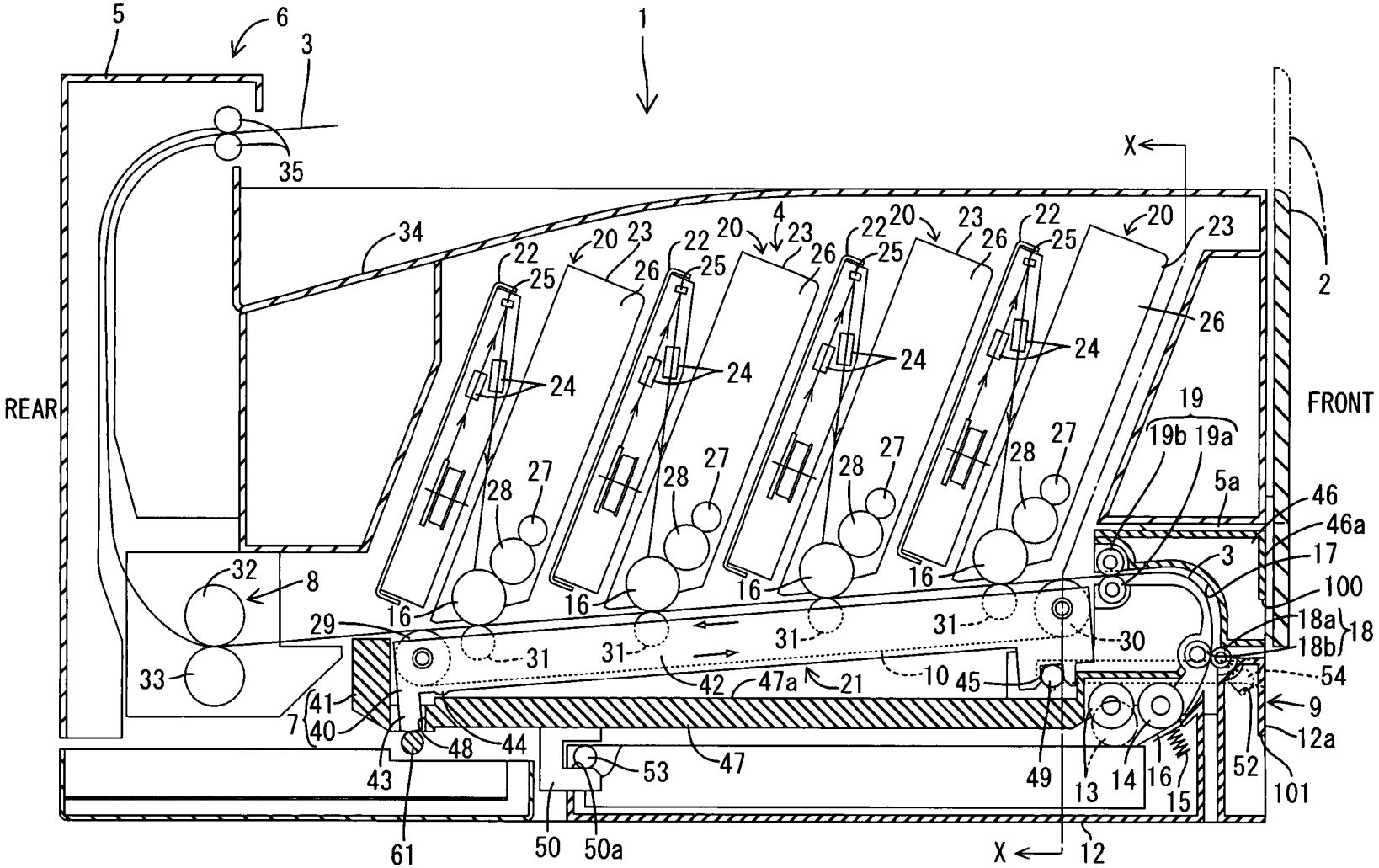
FIG. 1 is a side sectional view of a printer according to an illustrative example of the invention showing its general configuration.

I. General Description of Structures According to at Least Some Examples of the Invention In the description that follows, various connections are set forth between elements in the overall structure. The reader should understand that these connections in general and, unless specified otherwise, may be direct or indirect and that this specification is not intended to be limiting in this respect.

An image forming apparatus in accordance with at least some examples of this invention may include: a case having an opening at one face thereof; and a drawable cartridge drawable through the opening, the drawable cartridge including a conveying belt configured to convey a recording medium from a side nearer to the opening toward a side away from the opening. The conveying belt optionally may be supported in the case by a plurality of shafts, and a feeding roller system may be provided for feeding the recording medium toward the conveying belt. This feeding roller system may be at least partially disposed between the opening and the conveying belt, optionally at a position to at least partially overlap with the conveying belt when viewed in a direction from the opening.

Another example aspect of this invention relates to a drawable cartridge, and optionally to a drawable cartridge capable of being drawn through an opening defined in a case of an image forming apparatus, e.g., like the image forming apparatuses described above. Drawable cartridges in accordance with at least some examples of this aspect of the invention may include a conveying belt system including a conveying belt configured to convey a recording medium along a transport path from a first side of the conveying belt toward a second side of the conveying belt (e.g., in a direction from a side nearer to the opening in the image forming apparatus toward a side away from the opening). The conveying belt optionally may be supported in the case of an image forming apparatus by a plurality of shafts. The drawable cartridge further may include a feeding roller system engaged with the conveying belt system for feeding the recording medium toward the first side of the conveying belt. The conveying belt system and the feeding roller system may be engaged with one another in a manner so as to be movable together as a unit in a first direction and such that at least a portion of the feeding roller system overlaps with the conveying belt when viewed in the first direction (e.g., in the direction from the opening of the image forming apparatus).

If desired, the feeding roller system may be at least partially disposed between an opening in the image forming apparatus and the conveying belt. In other words, the feeding roller system in accordance with at least some example structures according to the invention may be at least partially disposed on a drawing path of the conveying belt toward the opening. In such systems, the size of the image forming apparatus may be reduced with respect to a direction perpendicular to the drawing direction (e.g., a direction perpendicular to a surface on which the image forming apparatus is placed). Further, the feeding roller system in such example systems may be drawn together with the conveying belt when the drawable cartridge is drawn. Therefore, in such example systems, the feeding roller system may not get in the way when the conveying belt is drawn through the opening (the drawable cartridge may be moved through the opening, for example, along a generally horizontal direction).

In image forming apparatuses according to at least some examples of this invention, the drawable cartridge may include a conveying belt unit with the conveying belt and a roller unit forming at least a portion of the feeding roller system. If desired, the belt unit and the roller unit may be separable from each other. The conveying belt, as a consumable, may have to be replaced with a new one in at least some instances. However, the replacement timing of the conveying belt often may not be coincident with a replacement timing of the feeding roller system or portions thereof. With the above-described example structure, the belt unit and the roller unit may be separable from each other so that only the required unit need be replaced at a given time, thereby reducing the operational and replacement costs.

Other example image forming apparatus structures according to at least some examples of this invention further may include a guide portion for guiding the roller unit toward the opening. This guide portion, in accordance with at least some example structures of the invention, may be formed on an inner side of the case. In such example structures, as the roller unit is drawn while being guided by the guide portion, the belt unit may be drawn out together with the roller unit, e.g., while also engaged with the roller unit. With the guide portion used in accordance with at least some examples of this invention, the roller unit and the belt unit may be smoothly drawn out.

Various other features and structures may be present in roller units in accordance with at least some examples of this invention. For example, the roller unit may include a tray, e.g., that covers a lower part of the conveying belt of the belt unit. With such a structure, the lower part of the conveying belt may be protected by the tray. In addition, the tray may prevent dust or other particles, which may fall down from the conveying belt, from scattering.

Another potential structural feature for image forming systems in accordance with at least some examples of this invention relates to the belt unit, e.g., of the types described above. These belt units optionally may include a leg portion that contacts the roller unit in such a manner so as to define a space between the conveying belt and the tray. In such image forming system structures, collisions or contact between the conveying belt and the roller unit tray may be prevented.

Image forming apparatuses in accordance with at least some examples of this invention may have a belt unit and a roller unit positioned with reference to a positioning member, optionally a positioning member common to both the belt unit and the roller unit. This positioning member may be supported by the case of the image forming apparatus. In general, the feeding roller may perform the function of feeding the recording medium to the conveying roller, and therefore, high accuracy positioning between the conveying belt and the feeding roller may be required. With the above-described structure, when the belt unit and the roller unit are positioned by the common positioning member, buildup of tolerances in both the belt and roller units can be prevented and thus, positioning may be performed accurately.

In accordance with at least some additional example structures according to the invention, an image forming apparatus may include a positioning member having a case opening-side positioning member that is supported by the case near the opening and a rear positioning member that is supported by the case at a rear side thereof with respect to a cartridge drawing direction. The belt unit and the roller unit may be positioned by these opening-side and rear positioning members in at least some example structures according to the invention. With such structures, positioning may be performed more accurately, e.g., as compared with the cases where the belt unit and the roller unit are positioned using only one of an opening-side positioning member or a rear positioning member.

The case of at least some image forming apparatuses in accordance with this invention may be provided with an engagement portion for engaging a feeding roller for the recording media. In at least some examples, this engagement portion may be slidable between an advanced position where it engages with an end of the feeding roller and a retracted position retracted from the advanced position along an axial direction of the feeding roller. If desired, the feeding roller may be rotated by application of drive force to the engagement portion when the engagement portion is in the advanced position. To more clearly illustrate at least some advantages of this structure, consider, for example, a structure in which the feeding roller is rotated by connection to a gear provided on the case. In such structures, the gear may get in the way when the drawable cartridge is drawn out. Furthermore, if plural feeding rollers are employed, the gears may interfere with one other. Therefore, in accordance with at least some examples of this invention, a so-called "coupling mechanism" may be employed, e.g., as the above-described structure in which the feeding roller may be rotated by an engagement portion slidable between the advanced position and the retracted position. In such example structures, the drawable cartridge may be drawn smoothly by placing the engagement portion in the retracted position when the drawable cartridge is drawn out.

If desired, the feeding roller unit or system used in accordance with at least some examples of this invention may include a plurality of feeding rollers that optionally rotate at different speeds from one other. Further, if desired, each of the feeding rollers may individually receive a drive force, optionally by engaging with an engagement portion as described above provided for each of the feeding rollers. If plural feeding rollers are rotated by drive force provided from a common engagement portion, a complicated gear mechanism may be required, e.g., on the drawable cartridge. With the above-described structure in accordance with at least some examples of this invention, however, each feeding roller may be rotated by drive force from an individual engagement portion. Thus, these example structures of the drawable cartridge may be simplified somewhat.

The conveying belt included in at least some example image forming apparatuses according to this invention may be rotated by a gear mechanism, e.g., disposed on a rear side of the coupling mechanism or engagement portion with respect to a cartridge drawing direction. Typically, higher driving accuracy can be realized with a gear mechanism as compared with a coupling mechanism. The above-described structure according to at least some examples of the invention may advantageously allow the drawable cartridge to be smoothly drawn out of the image forming apparatus.

Image forming apparatuses according to at least some examples of this invention further may include a recording medium accommodating cartridge that accommodates recording media to be fed to the conveying belt. The recording medium accommodating cartridge may be disposed, for example, at a position to at least partially overlap with the feeding roller when viewed in a direction from the opening in the image forming apparatus case. The recording medium accommodating cartridge in accordance with at least some examples of this invention may engage with the drawable cartridge and may be drawn from the case together, as a unit, with the drawable cartridge. By disposing the recording medium accommodating cartridge at a position to at least partially overlap with a drawing direction of the feeding roller, the size of the image forming apparatus may be reduced at least somewhat (as compared with structures that do not include this feature).

The recording medium accommodating cartridge in accordance with at least some example aspects according to the invention may include an engagement portion configured to engage with a drawable cartridge, e.g., of an image forming apparatus, such that the recording medium accommodating cartridge is movable together with the drawable cartridge. This engagement portion, when present, may be used to help position the recording medium accommodating cartridge relative to the drawable cartridge when the engagement portion of the recording medium accommodating engages with the drawable cartridge.

If desired, in accordance with at least some examples of this invention, the drawable cartridge and the recording medium accommodating cartridge may be disengaged from one another when the recording medium accommodating cartridge is drawn, e.g., such that the recording medium accommodating cartridge can be independently drawn from the case without also drawing the drawable cartridge. With such a structure, only the recording medium accommodating cartridge may need to be drawn, for example, when recording media are added to the recording medium accommodating cartridge. Furthermore, if desired, each of the drawable cartridge and the recording medium accommodating cartridge may have a separate handle. With such structures, an operation of simultaneously drawing both the drawable cartridge and the recording medium accommodating cartridge may be performed without being mistaken for an operation of drawing only the recording medium accommodating cartridge, or vice versa.

Image forming apparatuses including roller units are described above. Aspects of this invention also may relate to the roller unit itself. In accordance with at least some examples of this invention, this roller unit may be capable of being drawn through an opening defined in a case of an image forming apparatus. The roller unit may include a feeding roller system configured to feed a recording medium toward a feeding roller system outlet (e.g., in a direction toward a conveying belt capable of conveying the recording medium in the case of an image forming apparatus). The roller unit in accordance with at least some examples of this invention further may include an engagement device configured to engage with a conveying belt unit including a conveying belt. This engagement device, in accordance with at least some example structures according to the invention, may enable the feeding roller system to be movable together with the conveying belt unit, e.g., when the roller unit is drawn through the opening. With such structures, when the roller unit is drawn, the belt unit engages with the roller unit and may be drawn together with the roller unit. If desired, the roller unit also may include a tray that covers a lower part of the conveying belt of the belt unit and/or a supporting device capable of supporting the conveying belt in a manner such that a space is defined between the tray and the conveying belt. In such a structural arrangement, when provided, the lower part of the conveying belt may be protected by the tray and/or the tray may prevent dust, particles, or debris, which may fall down from the conveying belt, from scattering.

Still further aspects of this invention relate to recording medium accommodating cartridges. Recording medium accommodating cartridges according to at least some examples of this invention may include an engagement portion configured to engage with a drawable cartridge (e.g., a cartridge capable of being drawn out of the image forming apparatus through an opening defined therein). The recording medium accommodating cartridge may be positioned relative to the drawable cartridge as the engagement portion of the recording medium accommodating cartridge engages with the drawable cartridge. If desired, in this manner, the recording medium accommodating cartridge can be drawn from the case of the image forming apparatus together with the drawable cartridge. With such a structure, the recording medium accommodating cartridge may be positioned relative to the drawable cartridge including the feeding roller, for example, so that feeding accuracy of the recording medium can be increased. Furthermore, by drawing the drawable cartridge, the recording medium accommodating cartridge also may be drawn. Thus, the drawing operation may be facilitated.

Given this general overview of various examples, structures, and aspects of the invention, more detailed descriptions of example structures according to the invention are provided below in conjunction with the attached drawings.

II. Detailed Description of Specific Example Structures According to the Invention 1. Structures of Image Forming Apparatuses A general configuration of a printer 1, as an example image forming apparatus according to at least some examples of this invention, will be described below with reference to FIG. 1. The printer 1 is a laser printer of a horizontal-tandem type in which four image forming units 20 are arranged generally horizontally, in line, along the right-left direction in FIG. 1. The printer 1 is provided in a main casing 5 with a sheet supply section 9 for supplying sheets 3, as recording media, an image forming section 4 for forming an image on the sheet 3, and a discharge section 6 for discharging the sheet 3 having the image formed thereon. Of course, if desired, the image forming apparatus may take on any desired form without departing from the invention including, for example, the form of a facsimile machine, a copier, a scanner, a combination multifunctional device, or the like.

The main casing 5 may be formed with an opening 5*a* on one face, e.g., at a lower part thereof. A drawable cartridge 7 and a sheet supply tray 12, examples of which are described in more detail below, can be drawn out through the opening 5*a*. The right side in the example printer structure 1 of FIG. 1 is defined as a front side of the printer 1 in which the drawable cartridge 7 is drawn out, and a side (left side in FIG. 1) opposite to the front side is defined as a rear side of the printer 1. When the printer 1 is viewed from the front side thereof (the right side in FIG. 1), its left side is defined as the left side of the printer 1 and its right side as the right side of the printer 1.

(1) Sheet Supply Section

The sheet supply section 9 is provided, in the bottom portion of the main casing 5, with a sheet supply tray 12 (e.g., drawable from the front side of the main casing 5 in this example printer structure 1) and a pick-up roller 13, as a feeding roller, is disposed at an upper front end portion of the sheet supply tray 12. The pick-up roller 13 is movable in the vertical direction. When a sheet 3 is supplied, the pick-up roller 13 moves down to contact the next uppermost sheet 3 in the sheet supply tray 12. As the pick-up roller 13 is rotated, the uppermost sheet 3 is fed in a sheet feeding direction.

A separation roller 14, as a feeding roller, and a separation pad 16 pressed against the separation roller 14 by an urging spring 15 are provided in front of the pick-up roller 13. The separation roller 14 and the separation pad 16 separate the sheets 3 fed by the pick-up roller 13 one by one, while holding a sheet 3 therebetween. The pick-up roller 13 is connected to the separation roller 14 through a gear. The pick-up roller 13 is driven by the rotation of the separation roller 14. As will be described below, the separation roller 14 may be disposed in a roller unit 41, and the urging spring 15 and the separation pad 16 may be disposed in the sheet supply tray 12, although other structural arrangements also are possible without departing from the invention.

A guide wall 17 of a substantially "U" shape is disposed above and in front of the separation roller 14 and the separation pad 16, so as to turn the feeding direction of the sheet 3 separated by the separation roller 14 and the separation pad 16 from the front side to the rear side of the main casing 5. A pair of opposing rollers 18 (18*a*, 18*b*), as feeding rollers, are disposed near an upstream end of the guide wall 17 with respect to the sheet feeding direction. The roller 18*a* disposed nearer to the front side of the main casing 5 is disposed in the sheet supply tray 12 and the roller 18*b* disposed behind the roller 18*a* is disposed in the drawable cartridge 7 in this example structure.

Register rollers 19, as feeding rollers, are provided near a downstream end of the guide wall 17 with respect to the sheet feeding direction. The register rollers 19 of this example include a drive roller 19*a* and a driven roller 19*b*. The sheet 3 fed by the opposing rollers 18 is fed to the register rollers 19 where the skew of the sheet 3 is corrected (if any), and the sheet is then fed onto a conveying belt 10.

(2) Image Forming Section

The image forming section 4 of this example structure is provided in the main casing 5 with one or more image forming units 20 (e.g., four units 20) for forming an image, a transfer unit 21 for transferring the formed image onto a sheet 3, and a fixing unit 8 for fixing the transferred image onto the sheet 3 by the application of heat and pressure.

(a) Image Forming Unit

Each image forming unit 20 in this example arrangement includes a photosensitive drum 16, a charger (not shown) for charging the photosensitive drum 16, a scanner unit 22 for forming an electrostatic latent image on the photosensitive drum 16, and a developer cartridge 23 for forming a developer image (e.g., a toner image) on the photosensitive drum 16 by supplying developer (e.g., toner) to the photosensitive drum 16. The charger, the scanner unit 22, and the developer cartridge 23 all may be disposed near the photosensitive drum 16 and/or at other appropriate locations (e.g., as are known and used in the art).

The charger may be, for example, a positively charging scorotron charger that generates corona discharge from a tungsten wire. The scorotron charger uniformly and positively charges a surface of the photosensitive drum 16. Such chargers are conventionally known and used in the art. Of course, any desired charging system may be used without departing from this invention.

The scanner unit 22 may include a laser emitting portion (not shown) for emitting a laser beam to form the electrostatic latent image on the photosensitive drum 16, lenses 24, and a reflecting mirror 25. Using the scanner unit 22, a laser beam emitted from the laser emitting portion may be scanned across the surface of the photosensitive drum 16 to form the electrostatic latent image thereon. Any desired scanning system may be used without departing from this invention, including conventional scanning systems known and used in the art.

A developer cartridge 23 also may be provided in the printer structure 1. The developer cartridge 23 may include, for example, a developer hopper 26 (with developer included therein), a supply roller 27, and a developing roller 28. The developer hopper 26 may be formed as an interior of the casing of the developing cartridge 23. Each developer hopper 26 of the image forming units 20 of this example structure contains, for example, one of yellow (Y), magenta (M), cyan (C), and black (K) color developer.

The developer supply roller 27 is disposed in the developer hopper 26 at a lower side thereof in this example structure. This example supply roller 27 includes a metal roller shaft covered by a roller portion formed of a conductive sponge material. The supply roller 27 is supported so as to rotate opposite to the developing roller 28 at a nip portion where the supply roller 27 and the developing roller 28 contact each other.

The developing roller 28 in this example structure is rotatably disposed at a lower rear portion of the supply roller 27 and positioned so as to contact the supply roller 27.

The developing roller 28 includes a metal roller shaft covered by a roller portion formed of an elastic material, such as a conductive rubber material.

(b) Transfer Unit

The transfer unit 21 in this example printer structure 1 is provided in the main casing 5, below the developing cartridge 23 so as to face the photosensitive drums 16. This example transfer unit 21 includes a conveying belt drive roller 29 and a driven roller 30, as shafts, a conveying belt 10 of an endless belt type, and transfer rollers 31.

The driven roller 30 of this example printer structure 1 is disposed on the front side of the main casing 5 near the downstream end of the guide wall 17. The conveying belt drive roller 29 is disposed on the rear side of the main casing 5, in front of the fixing unit 8 but behind the photosensitive drum 16 of the rearmost image forming unit 20.

A conveying belt 10 is looped around the conveying belt drive roller 29 and the driven roller 30. The conveying belt 10 is disposed such that its outer surface contacts all of the photosensitive drums 16 of the image forming units 20. The driven roller 30 is driven by the conveying belt drive roller 29, and this action moves the conveying belt 10 around between the conveying belt drive roller 29 and the driven roller 30 in the counterclockwise direction, as indicated by arrows in FIG. 1, so as to move in the same direction as the photosensitive drums 16 of the image forming units 20 at the contact surface between the photosensitive drums 16 and the conveying belt 10. The conveying belt 10 conveys the sheet 3 fed by the register rollers 19 from the front side of the main casing 5 to its rear side.

Each transfer roller 31 in this example printer structure 1 is disposed at an inner side of the conveying belt 10 with the conveying belt 10 interposed between the transfer roller 31 and the photosensitive drum 16, so as to face one of the photosensitive drums 16 of the image forming units 20. The transfer rollers 31 in this example structure include a metal roller shaft covered by a roller portion formed of an elastic material, such as a conductive rubber material.

The transfer rollers 31 are rotatably disposed and move in the counterclockwise direction to move in the same direction as the conveying belt 10 at the contact surface between the conveying belt 10 and the transfer rollers 31. During the transfer of the developer image carried on the photosensitive drum 16 to the sheet 3, a specified voltage may be applied to the transfer roller(s) 31 from a power source (e.g., an appropriate transfer bias may be applied between the transfer roller 31 and the photosensitive drum 16 under a constant current control) such that the developer image is better and/or more completely transferred to the sheet 3.

(c) Fixing Unit

The fixing unit 8 in this example printer structure 1 is disposed on the downstream side (left side in FIG. 1) with respect to the sheet feeding direction, behind the image forming units 20 and the transfer unit 21. This example fixing unit 8 includes a heat roller 32 and a pressure roller 33. The heat roller 32 is formed of a metal tube whose surface has a release layer. The heat roller 32 accommodates therein a halogen lamp disposed along an axial direction of the metal tube. The surface of the heat roller 32 is heated up to a developer fixing temperature. The pressure roller 33 is disposed so as to press against the heat roller 32, e.g., under a desired contact pressure.

(3) Discharge Section

The discharge section 6 in this example printer structure 1 is disposed in the main casing 5 on an upper rear side thereof, downstream of the fixing unit 8 with respect to the sheet feeding direction. The discharge section 6 includes a pair of discharging rollers 35 for discharging the sheet 3 having the image fixed thereon, and a discharge tray 34 for stacking thereon the sheets 3 that have been subjected to all of the image forming processes in the printer 1.

Figure 2:
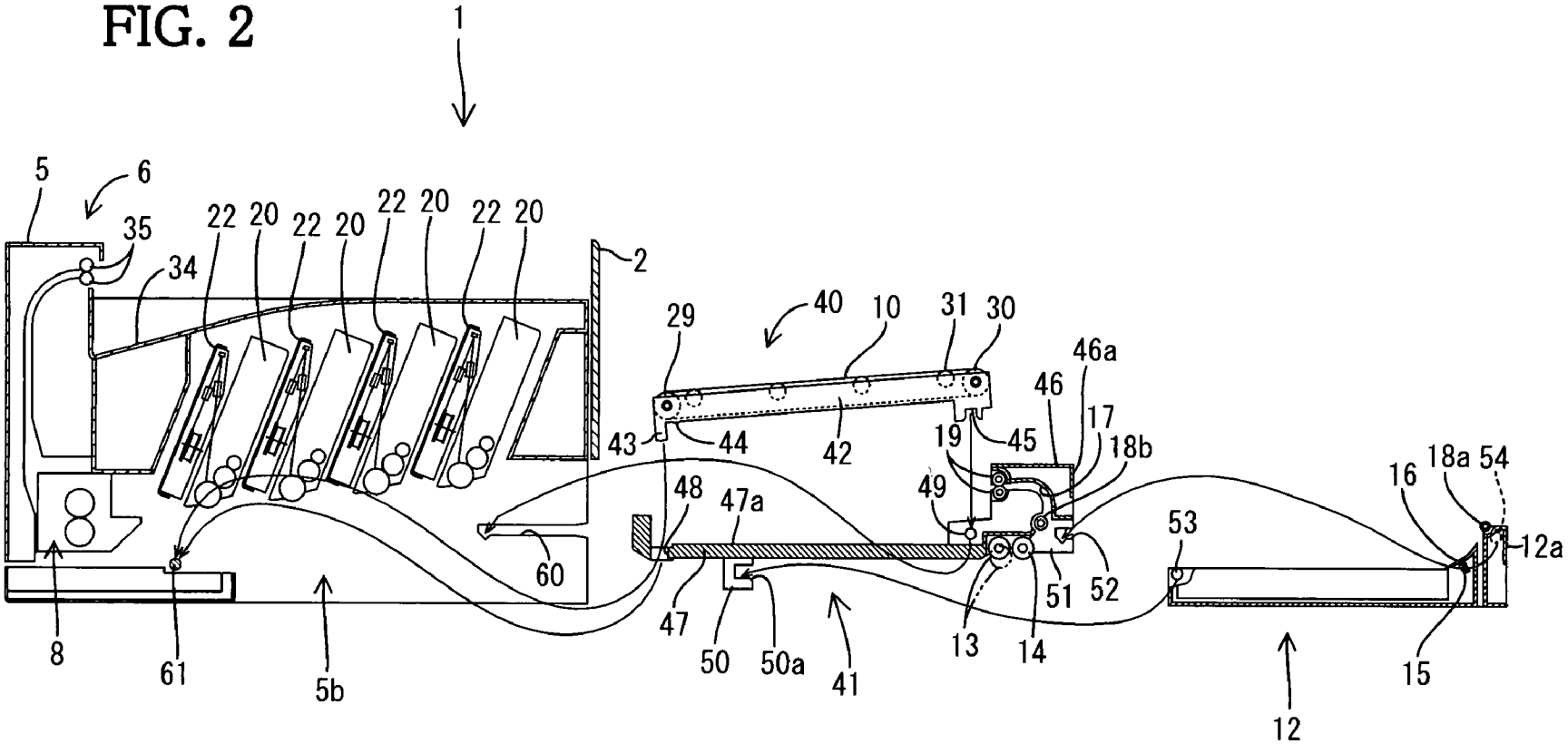
FIG. 2 is a sectional side view of the example printer structure of FIG. 1 showing a state in which a sheet supply tray, a roller unit, and a belt unit are drawn out from the printer and are separated from each other.

2. Structures of a Drawable Cartridge, Sheet Supply Tray, and Main Casing (1) Drawable Cartridge The drawable cartridge 7 of this example printer structure 1 according to the invention includes a belt unit 40 provided with conveying belt 10, and a roller unit 41 provided with pick-up roller 13, separation roller 14, roller 18*b*, and register rollers 19. FIG. 2 shows the sheet supply tray 12, the roller unit 41, and the belt unit 40 drawn out from the printer 1, through the opening 5*a* of the main casing 5, and separated from each other. Various features of the drawable cartridge 7 are described in more detail below.

(a) Belt Unit

The transfer unit 21 described above is disposed in this example printer structure 1 in a belt frame 42 of the belt unit 40. The belt frame 42 may be, for example, rectangular shaped. The belt frame 42 supports the conveying belt drive roller 29 and the driven roller 30 at front and rear ends thereof, respectively. The upper and lower parts of the conveying belt 10 are exposed from an opening defined at the upper and lower sides of the belt frame 42. In this illustrated example structure, the upper side of the conveying belt 10 (e.g., where the transfer rollers 31 are pressed against) protrudes slightly upward from and/or outside of the belt frame 42.

In this example printer structure 1, a pair of belt rear end protrusions 43 extend downward and are disposed at right and left sides of the belt frame 42 on its lower rear end portions, e.g., where the conveying belt drive roller 29 is disposed (only one protrusion 43 is shown in FIG. 2). As shown in FIGS. 1 and 2, a pair of leg portions 44, as supporting devices, are disposed at the right and left sides of the belt frame 42 in front of the belt rear end protrusions 43 (only one leg portion 44 is shown in FIGS. 1 and 2).

A pair of belt front end recesses 45 are disposed at the right and left sides of belt frame 42 on its lower front end portions, e.g., where the driven roller 30 is disposed (only one recess 45 is shown in FIG. 2). Each belt front end recess 45 of this example structure is defined by two projections disposed away from one another in the front-to-rear direction.

(b) Roller Unit

The roller unit 41 in this example printer structure 1 rotatably supports the pick-up roller 13, the separation roller 14, the roller 18*b*, and the register rollers 19. The roller unit 41 of this example is structured so as to integrally include a roller block portion 46 where the guide wall 17 is disposed and a tray 47 that extends rearward from a lower rear portion of the block portion 46.

The tray 47 in this example roller unit structure 41 includes a substantially flat box shape that is open upward. The tray 47 has a size such that it can accommodate the belt unit 40 therein. A pair of holes 48 is formed on a rear end of a surface 47*a* of the tray 47. This pair of holes 48 receives the respective belt rear end protrusions 43 when the belt unit 40 is accommodated in the tray 47 (only one hole 48 is shown in FIG. 2). Disposed at a front end of the tray 47, somewhat away from the surface 47*a*, is an opening-side positioning bar 49 that passes through right and left walls of the tray 47.

Figure 9:
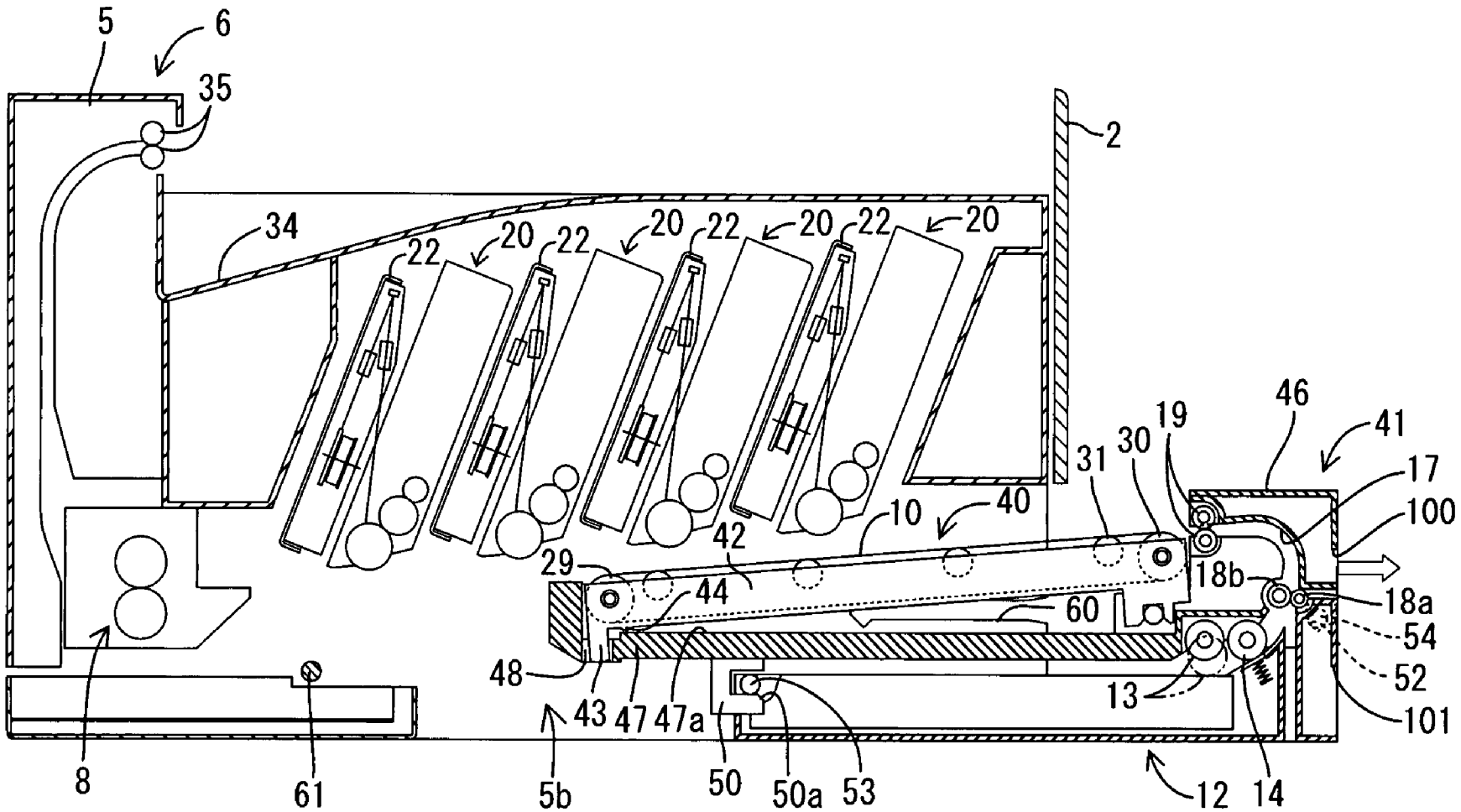
FIG. 9 is a sectional side view of the example printer structure of FIG. 1 showing a state in which the drawable cartridge is drawn from the printer.

The belt unit 40 is accommodated in the tray 47 by fitting the belt rear end protrusions 43 into the respective holes 48 and fitting the belt front end recesses 45 over the opening-side positioning bar 49. When the drawable cartridge 7 is not installed in the main casing 5, the leg portions 44 contact the surface 47*a* of the tray 47 so that the lower part of the conveying belt 10 can be prevented from contacting the surface 47*a*, as can be seen in FIG. 9.

A pair of rear engagement portions 50 including frontward-open recesses 50*a* are formed at the right and left side ends of the tray 47, on its lower surface, in this example roller unit structure 41 (only one rear engagement portion 50 is shown in FIG. 2). An entrance for allowing the roller 18*a* disposed in the sheet supply tray 12 to enter the roller block portion 46 is formed on a front face 46*a* of the roller block portion 46. Right and left walls 51 of the roller block portion 46 have opening-side engagement portions 52 cut out from the front face 46*a* (only one opening-side engagement portion 52 is shown in FIG. 2). Each opening-side engagement portion 52 has a larger portion at a rear side thereof. When the sheet supply tray 12 is set or engaged with the drawable cartridge 7, as shown in FIGS. 1 and 9, opening-side engagement protrusions 54 on the sheet supply tray 12 are fitted into the larger portions of the opening-side engagement portions 52 of the roller unit 41. Thus, the sheet supply tray 12 may be placed in position. A handle 100, as shown in FIG. 1, is provided on the front face 46*a* such that a user can hook their fingers over the handle 100 (e.g., for drawing the roller unit 41 out of the casing 5).

(2) Sheet Supply Tray

The roller 18*a* is rotatably disposed at an upper portion of a front wall 12*a* of the sheet supply tray 12. The urging spring 15 and the separation pad 16 are disposed below and behind the roller 18*a*. Rear engagement protrusions 53 (only one protrusion 53 is shown in FIG. 2) that engage with the respective frontward-open recesses 50*a* of the rear engagement portions 50 of the roller unit 41 are disposed at rear portions of the right and left walls of the sheet supply tray 12. Disposed at upper right and left portions of the front wall 12*a* of the sheet supply tray 12 are the opening-side engagement protrusions 54 that engage with the relevant opening-side engagement portions 52 of the roller unit 41 (only one protrusion 54 is shown in FIG. 2). A handle 101, as shown in FIG. 1, is provided on the front wall 12*a* such that a user can hook their fingers over the handle 101 (e.g., when drawing the sheet supply tray 12 from the printer 1).

Figure 3:
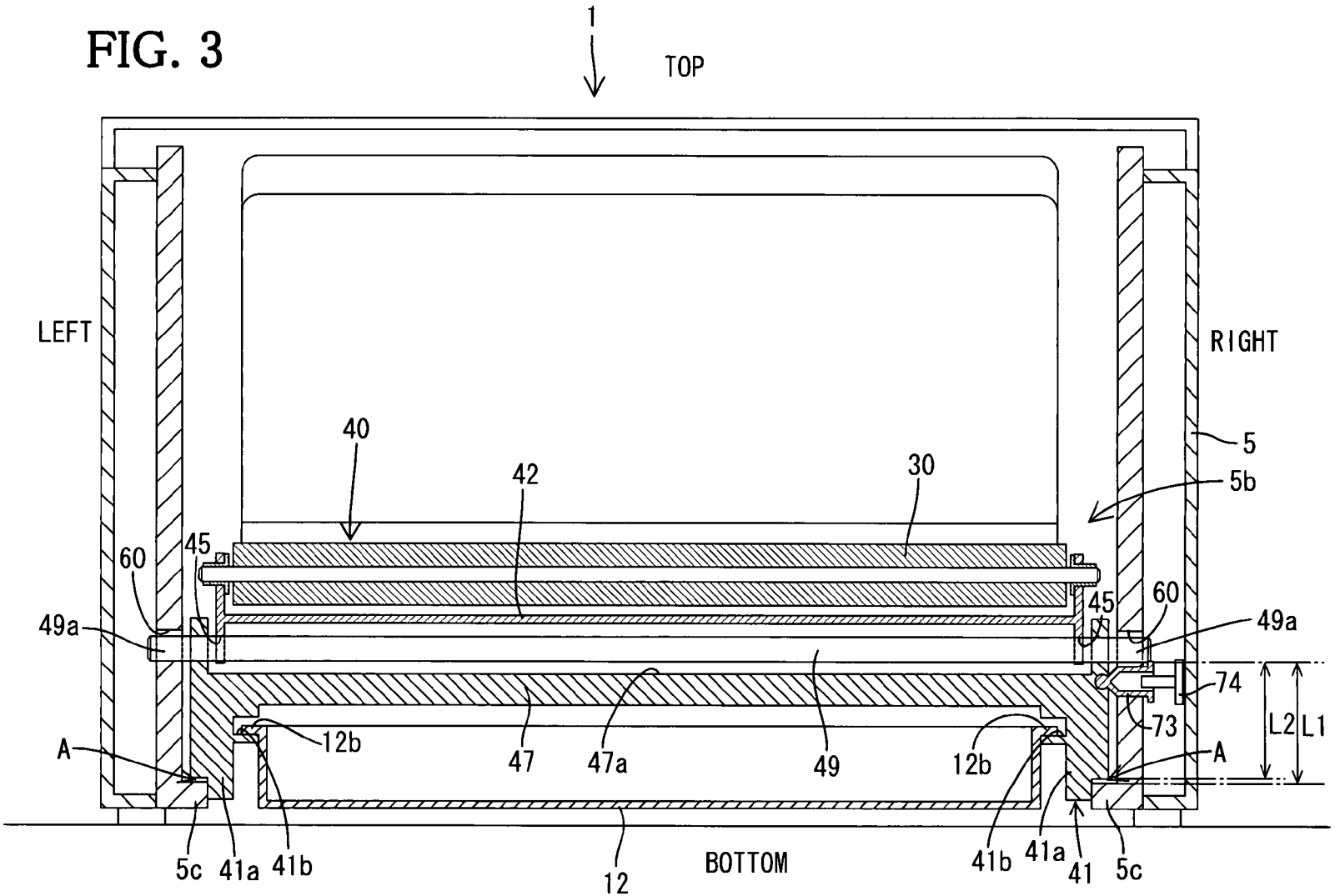
FIG. 3 is a sectional view of a main casing, the sheet supply tray, and a drawable cartridge taken along the line X-X shown in FIG. 1.

FIG. 3 is a sectional view of the main casing 5, the sheet supply tray 12, and the drawable cartridge 7 taken along the line X-X shown in FIG. 1. As shown in FIG. 3, the sheet supply tray 12 is provided at its outer right and left surfaces with ribs 12*b* that extend rearward. Extended walls 41*a* (only one shown in FIG. 3) that extend downward from the lower side of the roller unit 41 are disposed so as to interpose the sheet supply tray 12 therebetween. Guide recesses 41*b* that extend rearward are formed on inner surfaces of the extended walls 41*a*.

The sheet supply tray 12 is guided toward the rear side in the main casing 5 by the ribs 12*b* and the guide recesses 41*b*. In the end, the rear engagement protrusions 53 and the opening-side engagement protrusions 54 of the sheet supply tray 12 are engaged with the relevant frontward-open recesses 50*a* and the opening-side engagement portions 52, respectively. Thus, in this manner, the sheet supply tray 12 is positioned relative to the roller unit 41, with respect to the rearward direction and the vertical direction, as shown in FIGS. 1 and 3.

(3) Structures of the Main Casing

The main casing 5 of this example structure has an accommodating space 5*b* in which the drawable cartridge 7 and the sheet supply tray 12 are accommodated. A pair of guide grooves 60, as guide portions, that extend rearward from the opening 5*a* are disposed on the right and left walls of the accommodating space 5*b* (see, for example, FIGS. 2 and 3). Each guide groove 60 has a larger portion at a rear end thereof.

When the installation of the drawable cartridge 7 in the main casing 5 is complete, as shown in FIG. 1, ends 49*a* (in FIG. 3) of the opening-side positioning bar 49 are positioned as fitted in the larger portions of the grooves 60. As shown in FIG. 2, a rear positioning bar 61 that extends between the right and left side walls of the accommodating space 5*b* is disposed at the rear side of the accommodating space 5*b* of the main casing 5.

As shown in FIG. 3, ribs 5*c* (only shown in FIG. 3) that extend rearward from the opening 5*a* are provided at the lower end portions of the right and left inner side walls of the accommodating space 5*b*. While the lower ends of the extended walls 41*a* of the roller unit 41 slide over the relevant ribs 5*c*, the roller unit 41 is inserted into the main casing 5 by sliding the ends 49*a* of the opening-side positioning bar 49, which extend through the right and left wall of the tray 47, along the guide grooves 60.

As shown in FIG. 3, the distance L1 from a bottom face of the groove 60 to an upper face of the rib 5*c* is set longer than the distance L2 from the bottom face of the groove 60 to a surface of the extended wall 41*a* that faces the rib 5*c*. Thus, the extended walls 41*a* are lifted from the ribs 5*c* at the front side of the roller unit 41 where the opening-side positioning bar 49 is disposed, by distance A, as shown in FIG. 3. In other words, the front side of the roller unit 41 is positioned relative to the main casing 5 only by the opening-side positioning bar 49, even after the ends 49*a* of the opening-side positioning bar 49 reach the larger portions of the guide grooves 60 upon the completion of the installation of the roller unit 42 in the main casing 5.

3. Mechanism for Rotating Various Rollers (1) Coupling Mechanism

Figure 4:
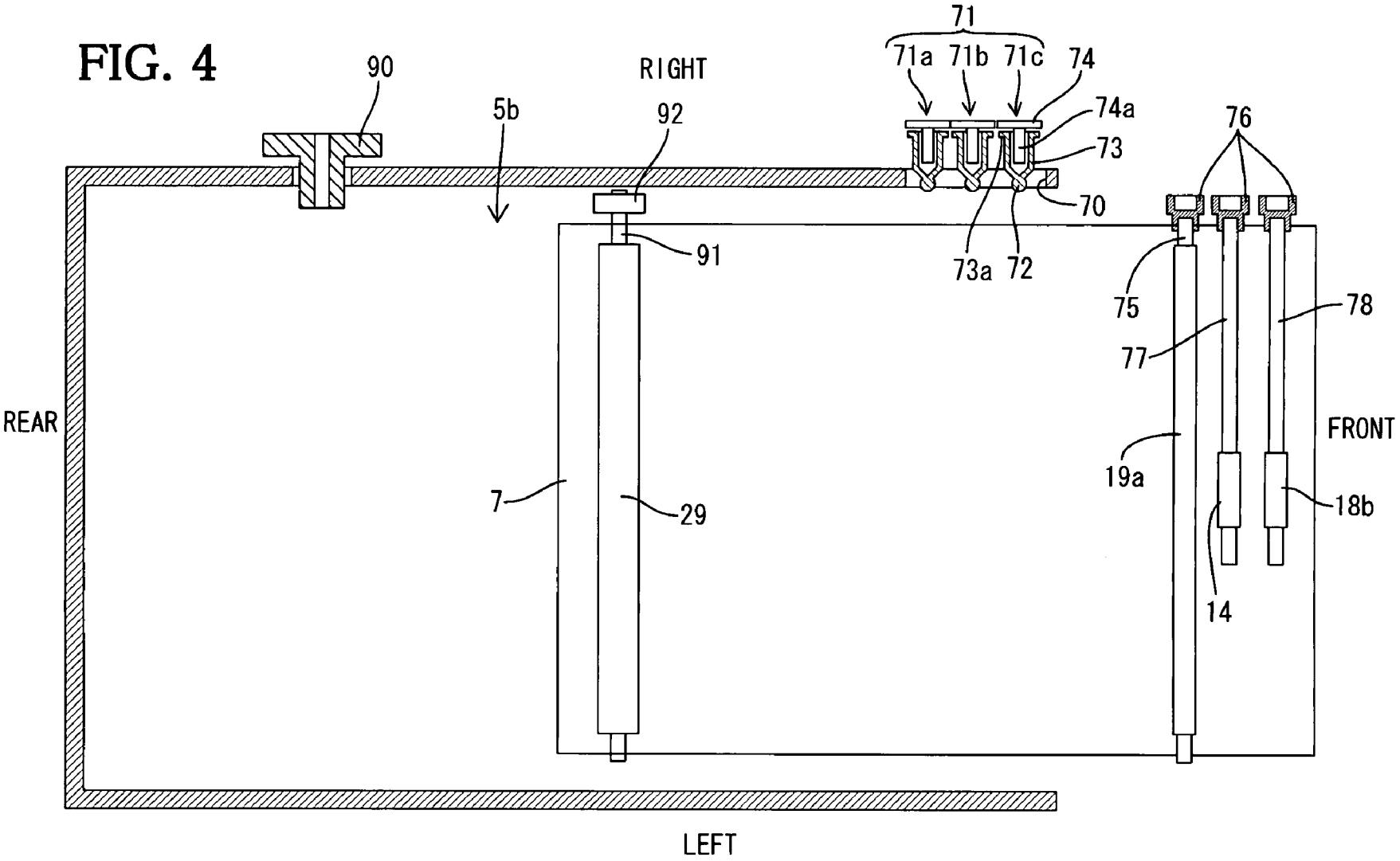
FIGS. 4-6 are sectional top views of the main casing and the drawable cartridge of the example printer structure of FIG. 1.
Figure 5:
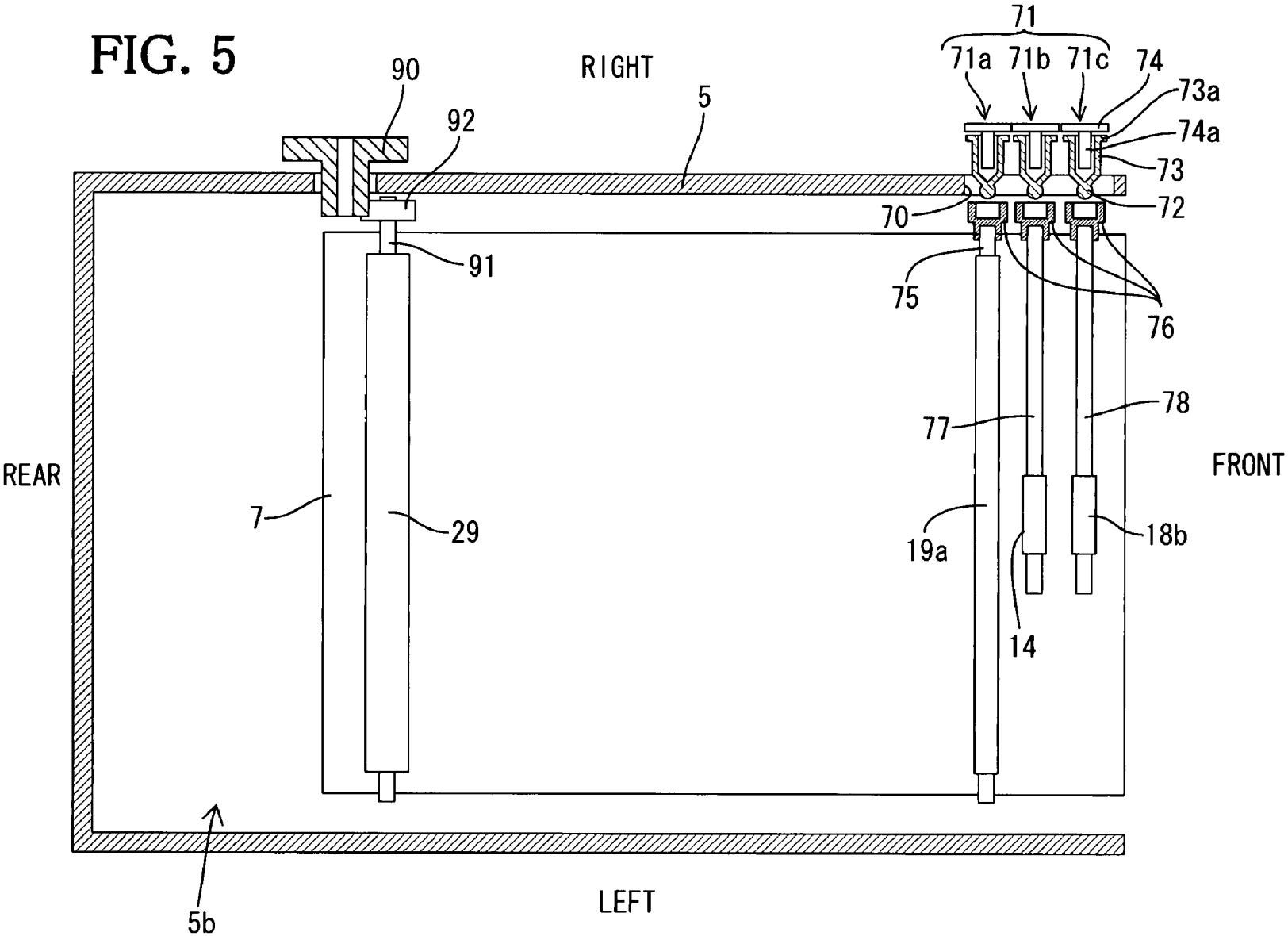
Figure 6:
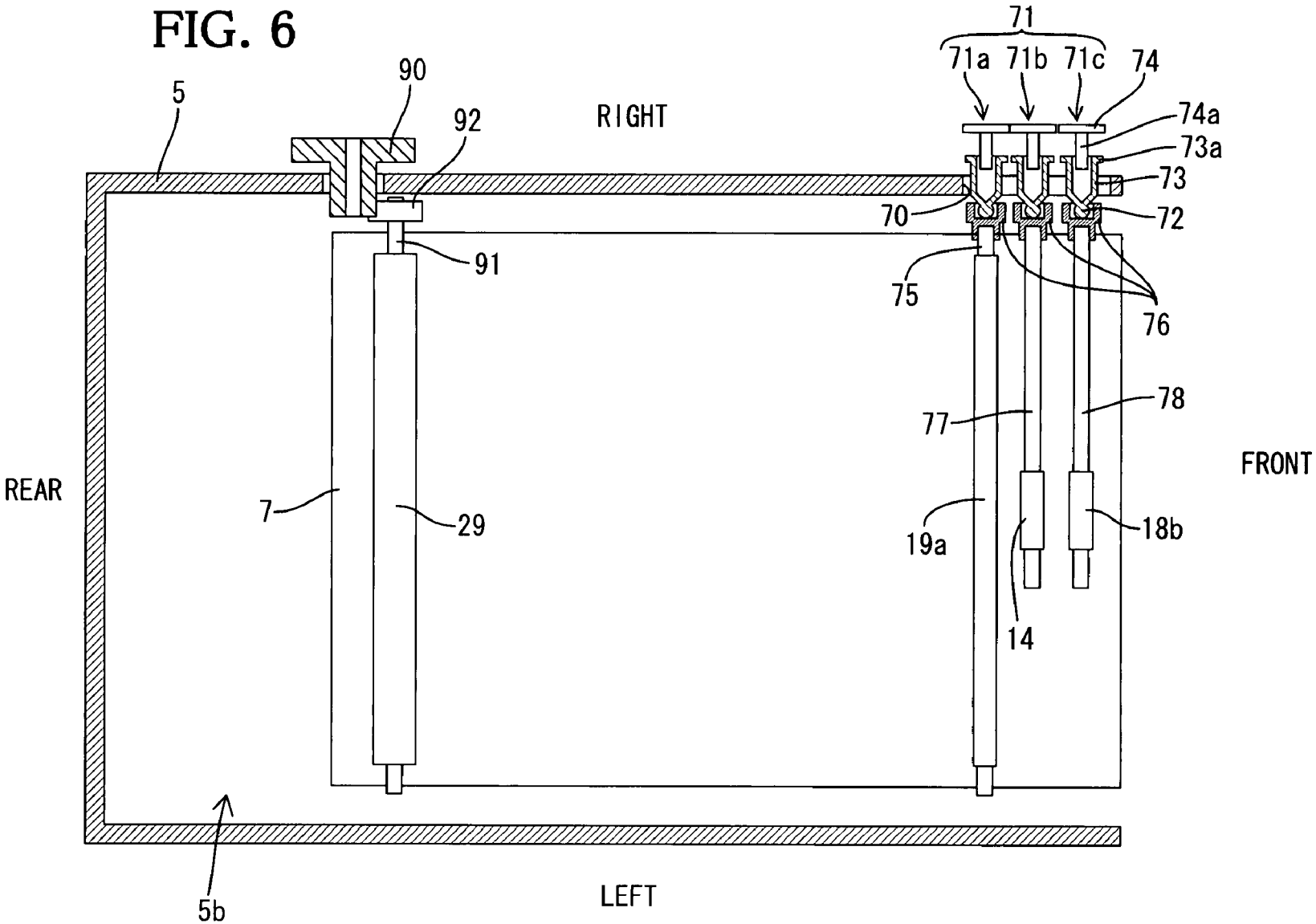

FIGS. 4-6 are sectional top views of the main casing 5 and the drawable cartridge 7 of this example structure according to the invention. The right side in FIGS. 4-6 is the front side of the printer 1. As shown in FIG. 4, disposed at the right side wall of the accommodating space 5*b* of the main casing 5 near the opening 5*a*, is a coupling mechanism chamber 70 where three coupling mechanisms 71 (71*a*-71*c*) are disposed.

Coupling mechanism 71*a* is for the register rollers 19; coupling mechanism 71*b* is for the separation roller 14; and coupling mechanism 71*c* is for the roller 18*b*. Each coupling mechanism 71 can be moved by a movement mechanism, as will be described below, between a retracted position, as shown in FIGS. 4 and 5, where the coupling mechanisms 71 are retracted in the coupling mechanism chamber 70 along an axial direction of the rollers 14, 18*b*, and 19, and an advanced position where the coupling mechanisms 71 protrude into the accommodating space 5*b*, as shown in FIG. 6.

Each of the coupling mechanisms 71 includes a cylindrical engagement member 73 having a pointed engagement portion 72 whose tip is directed toward the accommodating space 5*b*, a disc member 74 having a projection 74*a* that is inserted into an opening formed on a base end of the engagement member 73, and an urging spring (not shown) that urges the engagement member 73 into which the projection 74*a* is inserted toward the accommodating space 5*b*. Each engagement member 73 has a large diameter portion 73*a* at the periphery of the base end of the engagement member 73. Each coupling mechanism 71 receives a drive force from a drive motor (not shown) provided in the main casing 5, and the engagement members 73 are rotatable.

In the drawable cartridge 7, an engaged member 76 is disposed at the right end of a rotating shaft 75 of the drive roller 19*a* of the register rollers 19. The engaged member 76 engages with the engagement portion 72 of the coupling mechanism 71*a* for the register rollers 19 that is disposed on the left in FIGS. 4-6. As the engagement member 73 of the coupling mechanism 71*a* rotates, the drive roller 19*a* of the register rollers 19 is rotated. Another engaged member 76 also is disposed at the right end of a rotating shaft 77 of the separation roller 14. This engaged member 76 engages with the engagement portion 72 of the coupling mechanism 71*b* for the separation roller 14 that is disposed in the middle in FIGS. 4-6. As the engagement member 73 of the coupling mechanism 71*b* rotates, the separation roller 14 is rotated. Further, another engaged member 76 is disposed at the right end of a rotating shaft 78 of the roller 18*b*. This engaged member 76 engages with the engagement portion 72 of the coupling mechanism 71*c* for the roller 18*b* that is disposed on the right in FIGS. 4-6. As the engagement member 73 of the coupling mechanism 71*c* rotates, the roller 18*b* is rotated.

Figure 7A:
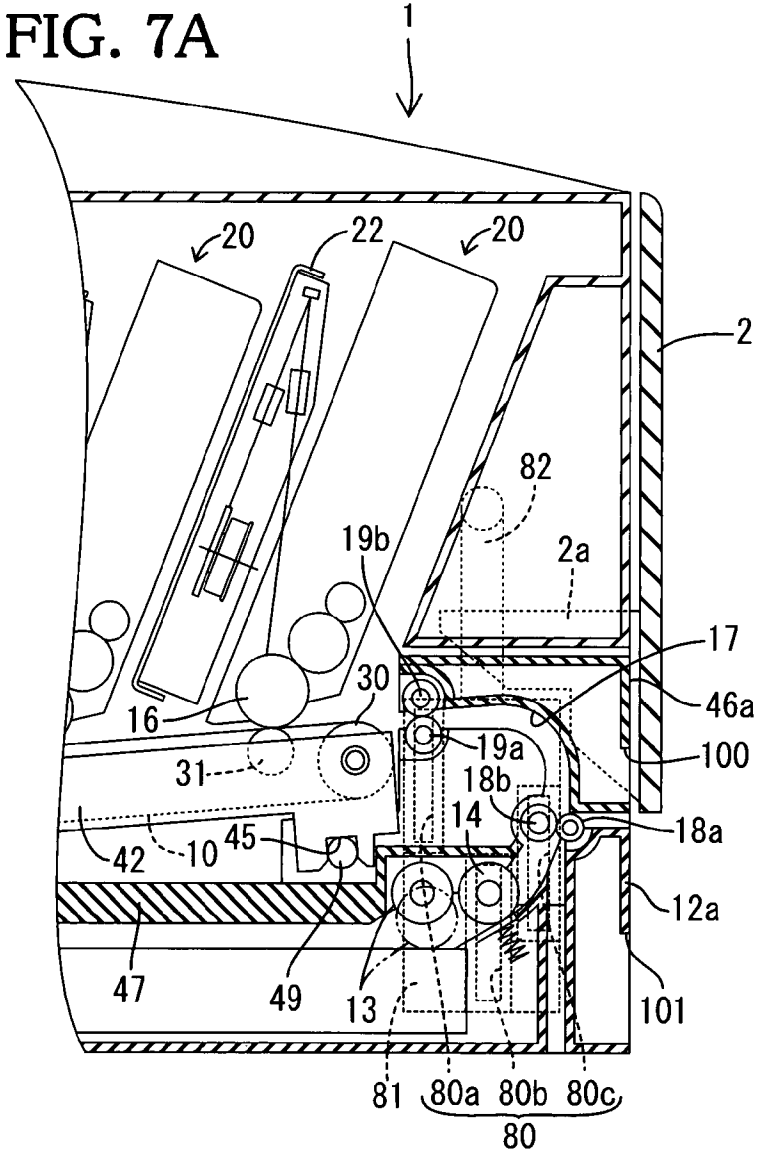
FIGS. 7A and 7B show a movement mechanism and a coupling mechanism of the example printer structure of FIG. 1 placed in an advance position.
Figure 7B:
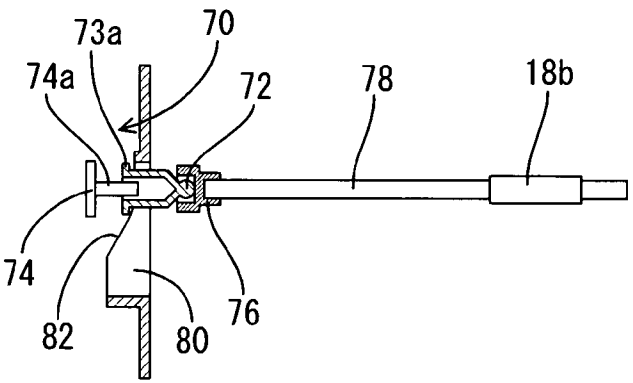
Figure 8B:
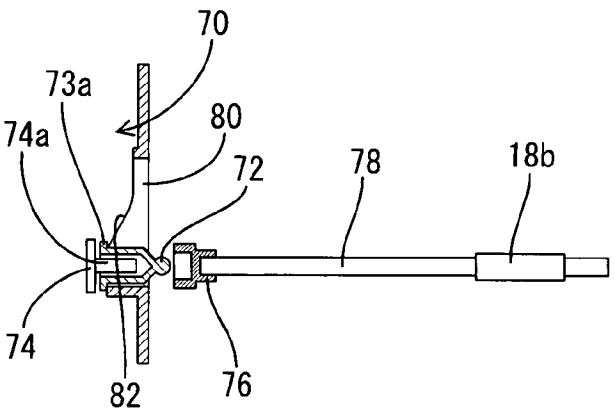
FIGS. 8A and 8B show the movement mechanism and the coupling mechanism placed in a retracted position.

Referring to FIGS. 7A through 8B, an example movement mechanism for retracting the coupling mechanisms 71 will be described below. FIGS. 7A and 8A show sectional side views of the front portion of the printer 1 and FIGS. 7B and 8B show the coupling mechanism 71*c* viewed from its rear side. As shown by dotted lines in FIGS. 7A and 8A, a vertically movable movement member 81 having three grooves 80 (80*a*-80*c*) that extend vertically is disposed in the main casing 5. Each of the grooves 80 is designed to have a width so as to allow a part of the engagement member 73 other than the large diameter portion 73*a* to be inserted into the groove 80, as shown in FIGS. 7B and 8B. The engagement member 73 of the coupling mechanism 71*c* for the roller 18*b* is inserted into the groove 80*c* disposed nearest to the opening 5*a* of the main casing 5. The engagement member 73 of the coupling mechanism 71*b* for the separation roller 14 is inserted into the groove 80*b* disposed behind groove 80*c*. The engagement member 73 of the coupling mechanism 71*a* for the drive roller 19*a* is inserted into the groove 80*a* disposed behind groove 80*b*.

Each of the grooves 80 has, at front and rear ends thereof, a tapered surface 82 that is tapered such that a lower side thereof protrudes further toward the coupling mechanism chamber 70 side (left side in FIGS. 7B and 8B). As shown in FIG. 7A, when the movement member 81 is in the lowermost position, each engagement member 73 is moved by an urging force of an urging spring to the advanced position, as shown in FIG. 7B, where each engagement member 73 is engaged with the relevant engaged member 76. When the movement member 81 is raised, the engagement members 73 are moved, against the urging force of the urging spring, to the retracted position, as shown in FIG. 8B, while the large diameter portions 73*a* are guided along the tapered surfaces 82.

As shown in FIG. 1, a cover 2 is slidably disposed on the front side of the printer 1. This cover is configured so as to move between a closed position and an open position. In the closed position, as shown by solid lines in FIG. 1, the cover 2 covers the front face 46*a* of the roller block portion 46 but does not cover the front wall 12*a* of the sheet supply tray 12. In the open position, as shown by double dashed chain lines in FIG. 1, the cover 2 moves further upward from the closed position and uncovers the front face 46*a* of the roller block portion 46.

An engagement arm 82 of substantially "L" shape is disposed on an upper end of the movement member 81, as shown in FIGS. 7A, 7B, 8A, and 8B. When the cover 2 is moved from the closed position to the open position, a pressing arm 2*a* provided on the rear side of the cover 2 contacts the engagement arm 82 from the underside thereof and raises the engagement arm 82.

(2) Belt Drive Mechanism

As shown in FIGS. 4-6, an output gear 90 is disposed in this example printer structure 1 on the right side wall of the accommodating space 5*b* behind the coupling mechanism chamber 70. The output gear 90 rotates as it receives drive force from a drive motor disposed in the main casing 5. An input gear 92 capable of engaging with the output gear 90 is mounted on the right end of a roller shaft 91 of the conveying belt drive roller 29. The input gear 92 receives the drive force when it is engaged with the output gear 90, as shown in FIGS. 5 and 6, and rotates the conveying belt drive roller 29.

4. Example Effects of these Example Structures (1) Accommodation of Drawable Cartridge and Sheet Supply Tray (a) As shown in FIG. 1, when the drawable cartridge 7 and the sheet supply tray 12 are accommodated in the accommodating space 5*b* and the cover 2 is in the closed position, the engagement members 73 of the coupling mechanisms 71 are in the advanced position, as shown in FIGS. 6, 7A, and 7B, and engage with the relevant engaged members 76. This engagement may be direct or indirect (e.g., through another structure or mechanism). Each engagement member 73 of the coupling mechanisms 71 may be rotated at a speed and a timing different from each other by a drive gear mechanism (not shown), which is driven upon receipt of the drive force from the drive motor. Accordingly, each of the roller 18*b*, the separation roller 14, and the register rollers 19 may be properly rotated at a specified speed.

In this illustrated example structure, the roller 18*b*, the separation roller 14, and the register rollers 19 can be individually driven by the receipt of drive force from the relevant engagement members 73 of the coupling mechanisms 71*a*-71*c*. If desired, the drive gear mechanism for driving each of the coupling mechanisms 71*a*-71*c* at different rotating speeds can be disposed on the main casing 5, and not on the drawable cartridge 7. However, if desired, the drive gear mechanism for driving the coupling mechanisms may be disposed on the drawable cartridge 7, in at least some example structures according to this invention.

(b) As shown in the example structure illustrated in FIGS. 5 and 6, the input gear 92 mounted on the conveying belt drive roller 29 may be engaged with the output gear 90 disposed on the main casing 5. In this example arrangement, the conveying belt 10 may be rotated upon the receipt of the drive force from the output gear 92. The input gear 92 is disposed in front of the output gear 90 in this example structure, and the input gear 92 and the output gear 90 are disposed on the rear side of the coupling mechanisms 71 in the accommodating space 5*b*. When the drawable cartridge 7 is drawn from the printer 1, the coupling mechanisms 71 are moved to the retracted position, as shown in FIG. 4, so that contact between the input gear 92 and the coupling mechanisms 71 can be prevented. With such a structure, a gear mechanism including the output gear 90 and the input gear 92 rather than a coupling mechanism can be used for movement of the conveying belt 10, for which high conveying accuracy is required. Of course, other structural arrangements and component parts may be used without departing from this invention.

(c) As shown in FIG. 1, when the drawable cartridge 7 and the sheet supply tray 12 are installed in the printer 1 in this example structure, each end 49*a* of the opening-side positioning bar 49 of the roller unit 41 contacts the lower surface of the larger portion of the relevant guide grooves 60. As described above, the front portion of the roller unit 41 is supported relative to the main casing 5 only by the opening-side positioning bar 49. The belt front end recesses 45 contact the opening-side positioning bar 49 from above. In other words, the front portions on the opening side of the roller unit 41 and the belt unit 40 are positioned with reference to the opening-side positioning bar 49 supported by the main casing 5.

The lower rear end of the roller unit 41 and the belt rear end protrusions 43 contact the rear positioning bar 61. At this time, the leg portions 44 are raised up from the surface 47*a* of the tray 47 by the contact between the rear positioning bar 61 and the belt rear end protrusions 43. In other words, the rear portions of the roller unit 41 and the belt unit 40 on the rear side in the accommodating space 5*b* are positioned with reference to the rear positioning bar 61. Therefore, the rollers 13, 14, 18, and 19 for feeding sheets 3 toward the conveying belt 10 can be positioned accurately relative to the conveying belt 10. Thus, with reference to the opening-side positioning bar 49 and the rear positioning bar 61, the conveying belt 10 can be positioned relative to the main casing 5 and the roller unit 41 can be positioned relative to the main casing 5. Therefore, the positioning of the conveying belt 10 and the roller unit 41 can be performed more accurately as compared with a case where positioning of the conveying belt 10 and the roller unit 41 are performed based on references different from each other. Further, the opening-side positioning bar 49 and the rear positioning bar 61 are supported directly by the main casing 5 in this example printer structure 1, and no components intervene between the conveying belt 10/the roller unit 41 and the opening-side positioning bar 49/the rear positioning bar 61. Therefore, tolerances of the components do not build up between the conveying belt 10/the roller unit 41 and the opening-side positioning bar 49/the rear positioning bar 61, and thus, positioning can be performed accurately relative to the main casing 5.

(d) The sheet supply tray 12 in this example printer structure 1 is positioned relative to the roller unit 41, not the main casing 5, by making the rear engagement protrusions 53 and the opening-side protrusions 54 of the sheet supply tray 12 fit into the rear engagement portions 50 and the larger portions of the opening-side engagement portions 52 of the roller unit 41, respectively. Accordingly, with this example structure 1, sheet conveying accuracy from the sheet supply tray 12 to the roller unit 41 can be increased.

(e) As shown in FIG. 1, the roller block portion 46 (including the rollers 13, 14, 18*b*, and 19 in this example structure) is disposed between the opening 5*a* and the conveying belt 10 such that the roller block portion 46 at least partially overlaps with the conveying belt 10 when the roller block portion 46 is viewed in a direction from the opening 5*a* side. Further, the sheet supply tray 12 is disposed such that the upper portion of the front wall 12*a* at least partially overlaps the roller block portion 46. Thus, the conveying belt 10, the roller block portion 46, and the sheet supply tray 12 may at least partially overlap when viewed from the opening 5*a* side, e.g., so that the height of the printer 1 can be reduced. When such structures are employed in accordance with at least some examples of this invention, the conveying belt 10 also can be taken out of the main casing 5 smoothly.

Figure 8A:
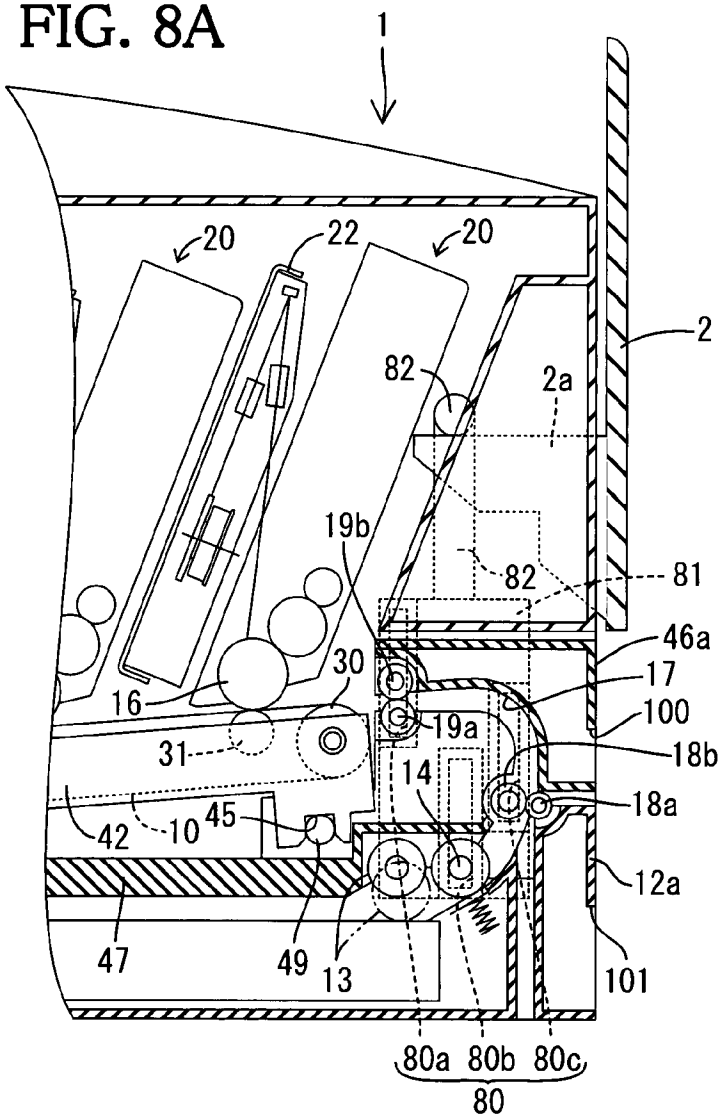

(2) Removal of Drawable Cartridge (a) When the drawable cartridge 7 is pulled out of the main casing 5 from the state shown in FIG. 1, the cover 2 is first raised to the open position. The movement member 81 is raised and the engagement members 73 of the coupling mechanisms 71 are moved from the advanced position to the retracted position and disengage from the engaged members 76, as shown in FIGS. 5, 8A, and 8B. That is, each engagement member 73 retracts into the coupling mechanism chamber 70 where the engagement members 73 are out of a drawing path for the drawable cartridge 7 and the input gear 92.

After the cover 2 is raised to the open position, as the drawable cartridge 7 is removed from the main casing 5 by pulling the handle 100 of the roller unit 41, the belt unit 40 mounted on the roller unit 41 is pulled out together with the roller unit 41, as shown in FIG. 9. At this time, the belt rear end protrusions 43 of the belt unit 40 no longer contact the rear positioning bar 61, and consequently, the leg portions 44 of the roller unit 41 contact the surface 47*a* of the tray 47. Thus, collision and/or contact between the lower part of the conveying belt 10 and the surface 47*a* of tray 47 can be prevented with the leg portions 44.

The sheet supply tray 12 can be pulled out of the main casing 5 together with the roller unit 41 by the engagement of the rear engagement protrusions 53 and the opening-side protrusions 54 of the sheet supply tray 12 with the rear engagement portions 50 and the opening-side engagement portions 52 of the roller unit 41, respectively.

Figure 10:
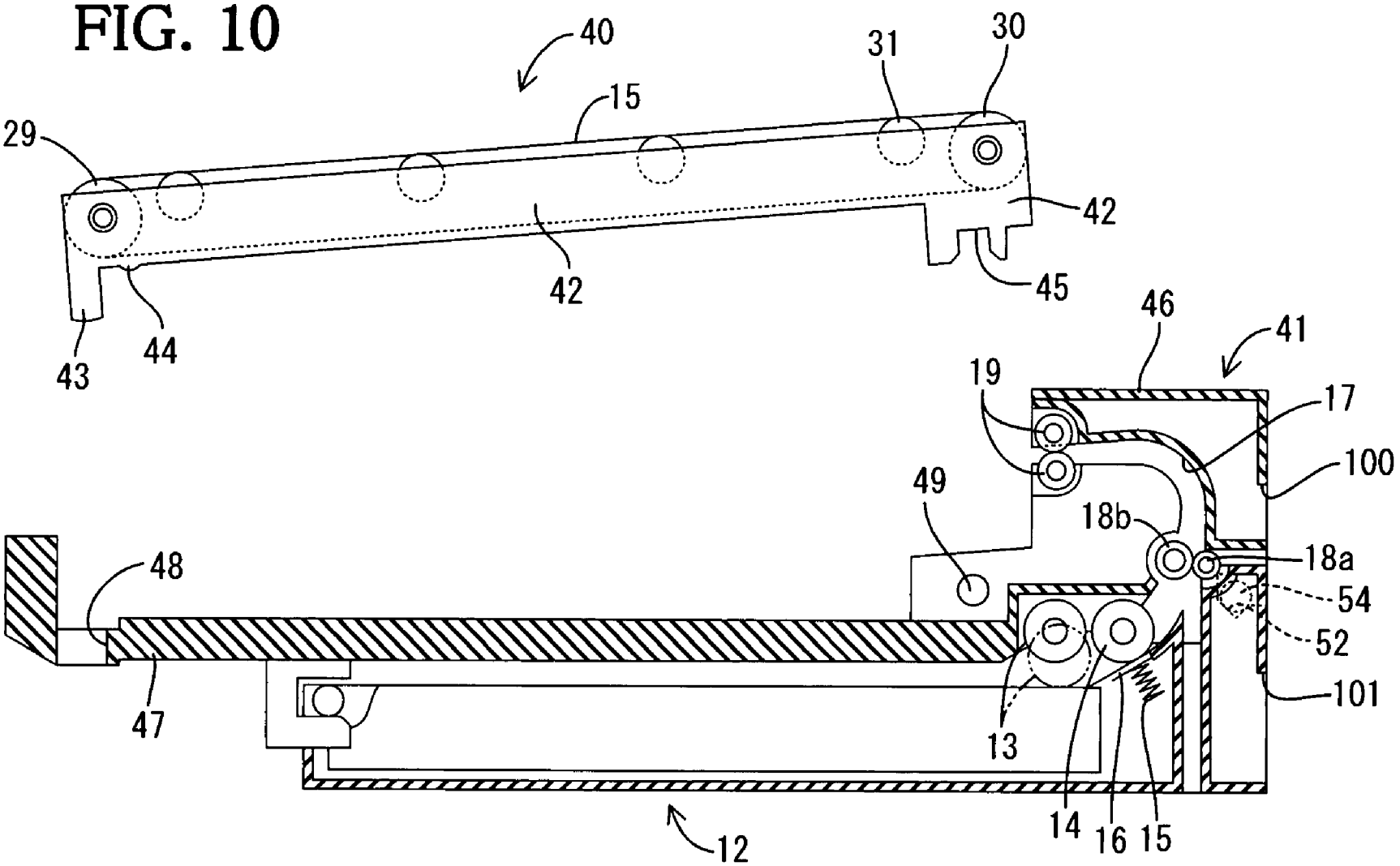
FIG. 10 is a side sectional view of the belt unit and the roller unit of the example printer structure of FIG. 1 shown separated from each other.

(b) After the drawable cartridge 7 is pulled out of the main casing 5, the belt unit 40 can be separated from the roller unit 41, as shown in FIG. 10.

Therefore, for example, when the conveying belt 10 is worn out or deteriorated, the belt unit 40 or only the conveying belt 10 can be replaced with new one.

(c) As shown in FIG. 1, the belt unit 40 is disposed on the roller unit 41 with the conveying belt 10 at an angle such that the conveying belt drive roller 29 side is lower than the driven roller 30 side. Each image forming unit 20 of this illustrated example structure also is disposed at an angle in association of the angled arrangement of the conveying belt 10. Accordingly, the drawable cartridge 7 can be drawn out of the main casing 5 with some distance between the conveying belt 10 and the photosensitive drums 16, without making the conveying belt 10 and the photosensitive drums 16 contact or slide against each other.

(3) Removal of Sheet Supply Tray

Figure 11:
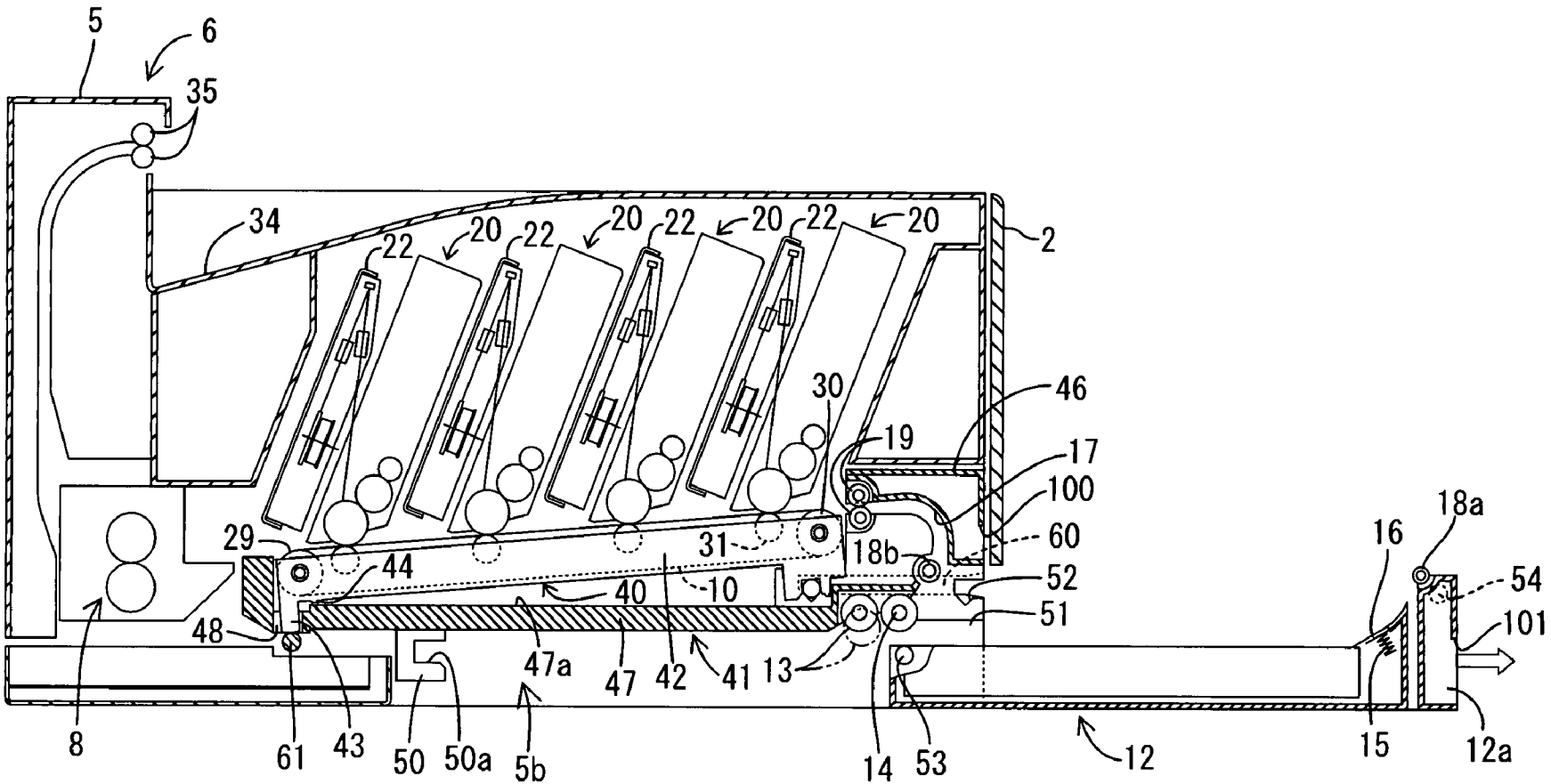
FIG. 11 is a sectional side view of the example printer structure of FIG. 1 showing a state in which only the sheet supply tray is drawn out from the printer.

As mentioned above, if desired in accordance with at least some example printer structures 1 according to the invention, the sheet supply tray 12 may be removed from the printer 1 separate from the drawable cartridge 7. In at least some such example structures 1, when additional sheets 3 need to be added to the sheet supply tray 12, only the sheet supply tray 12 needs to be pulled out from the main casing 5, optionally with the cover 2 remaining in the closed position, e.g., by pulling the handle 101 of the sheet supply tray 12, as shown in FIG. 11. Independent withdrawal of the sheet supply tray 12 may be accomplished in this example printer structure 1 because the rear engagement protrusions 53 and the opening-side protrusions 54 of the sheet supply tray 12 may be readily disengaged from the rear engagement portions 50 and the opening-side engagement portions 52 of the roller unit 41, respectively, by the pulling action. Thus, only the sheet supply tray 12 can be pulled out from the casing 5, if desired.

5. Conclusion

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

(1) In the illustrated example structure 1, the drawable cartridge 7 is substantially horizontally pulled out of the printer structure 1. However, the drawable cartridge 7 also may be pulled out diagonally, perpendicular to a surface where the printer 1 is placed, and/or in any other desired direction without departing from the invention.

(2) In the illustrated example structure 1, the leg portions 44, as supporting devices, are provided as part of the belt unit 40 structure. However, if desired, the leg portions 44 and/or other supporting structures may be provided on the tray 47 and/or on both the tray 47 and the belt unit 40 without departing from the invention.

(3) In the illustrated example structure 1, the drawable cartridge 7 can be separated from the main casing 5 and the sheet supply tray 12 can be separated from the drawable cartridge 7. However, if desired, the drawable cartridge 7 does not have to be separated from and/or removable from the main casing 5. For example, if desired, the cartridge 7 may be drawable from (but remaining attached to) the main casing 5, the drawable cartridge 7 may be integrally formed with a sheet supply tray 12, the sheet supply tray 12 may be drawable from (but remaining attached to) the cartridge 7, etc.

(4) The rollers 13, 14, 18, and 19 are disposed in the illustrated example structure 1 so as to overlap the conveying belt 10 when viewed from the opening 5*a* side (e.g., in the pulling direction). However, if desired, not all of the rollers 13, 14, 18, and 19 needs to overlap the conveying belt 10 when viewed from the opening 5*a* side. For example, even if only some portion of the rollers 13, 14, 18, and 19 overlap the conveying belt 10 when viewed in a direction from the opening 5*a* side, the height of the printer 1 can be reduced.

What is claimed is:

1. An image forming apparatus, comprising:

a case having an opening at one face thereof;

a drawable cartridge drawable through the opening, the drawable cartridge including a conveying belt configured to convey a recording medium from a side nearer to the opening toward a side away from the opening, a feeding roller system for feeding the recording medium toward the conveying belt, the feeding roller system at least partially disposed between the opening and the conveying belt at a position to at least partially overlap with the conveying belt when viewed in a direction from the opening, a belt unit having the conveying belt and a roller unit having at least a portion of the feeding roller system, and wherein the belt unit is removably attachable from the roller unit; and a recording medium accommodating cartridge that accommodates the recording medium to be fed to the feeding roller system, wherein the recording medium accommodation cartridge and the drawable cartridge are configured to be removed through the opening while being engaged with one another in a first state, and the recording medium accommodation cartridge is configured to be removed through the opening when the drawable cartridge and the recording medium accommodating cartridge are disengaged from one another in a second state, and wherein the conveying belt is configured to be removed from the belt unit when the drawable cartridge has been removed from the image forming apparatus.

2. The image forming apparatus according to claim 1, wherein the drawable cartridge is drawable through the opening along a substantially horizontal direction.

3. The image forming apparatus according to claim 1, wherein each of the drawable cartridge and the recording medium accommodating cartridge has a handle.

4. The image forming apparatus according to claim 1, wherein a guide portion for guiding the roller unit toward the opening is included at an inner side of the case, and as the roller unit is drawn while being guided by the guide portion, the belt unit is drawn out together with the roller unit.

5. The image forming apparatus according to claim 1, wherein the roller unit has a tray that at least partially covers a lower part of the conveying belt of the belt unit.

6. The image forming apparatus according to claim 5, wherein the belt unit has a leg portion that contacts the roller unit as the roller unit is drawn and at least partially defines a space between the conveying belt and the tray.

7. The image forming apparatus according to claim 1, further comprising:

a positioning system for positioning the belt unit and the roller unit.

8. The image forming apparatus according to claim 7, wherein the positioning system includes an opening-side positioning member that is supported by the case proximate to the opening and a rear positioning member that is supported by the case at a rear side thereof with respect to a cartridge drawing direction.

9. The image forming apparatus according to claim 1, wherein the case is provided with an engagement portion slidable between an advanced position where the engagement portion directly or indirectly engages with at least a portion of the feeding roller system and a retracted position retracted from the advanced position along an axial direction of the feeding roller system, wherein the feeding roller system is rotatable by an application of drive force to the engagement portion when the engagement portion is in the advanced position.

10. The image forming apparatus according to claim 9, wherein the feeding roller system includes a plurality of rotatable feeding rollers, and each of the feeding rollers individually receives the drive force by engaging with a portion of the engagement portion provided for each of the feeding rollers.

11. The image forming apparatus according to claim 9, wherein the conveying belt is rotated by a gear mechanism disposed on a rear side of the engagement portion with respect to a cartridge drawing direction.

12. The image forming apparatus according to claim 1, wherein the recording medium accommodating cartridge is disposed at a position to at least partially overlap with the feeding roller system when viewed in a direction from the opening.

13. The image forming apparatus according to claim 1, wherein the recording medium accommodating cartridge has an engagement portion configured to engage with the drawable cartridge.

14. The image forming apparatus according to claim 1, wherein the recording medium accommodating cartridge is configured to be independently drawable from the drawable cartridge in the second state and only the recording medium accommodating cartridge is drawn in the second state.

15. An apparatus for use with an image forming apparatus, the apparatus comprising:

an accommodation cartridge for containing a recording medium; and a second cartridge, the second cartridge configured to engage the accommodation cartridge, the second cartridge comprising:

a portion of a feeding roller system, feeding roller system for feeding the recording medium from the accommodation cartridge, and a belt unit engaging the feeding roller system, the belt unit comprising a conveying belt, the conveying belt for receiving the recording medium fed from the feeding roller system and for conveying the recording medium, wherein the accommodation cartridge and the second cartridge are configured to be removed through an opening of the image forming apparatus while being engaged with one another, and wherein the conveying belt is configured to be removed from the belt unit when the second cartridge has been removed from the image forming apparatus.

16. The apparatus according to claim 15, wherein the accommodation cartridge is configured to be detached from the second cartridge for removal through the opening while at least a portion of the second cartridge remains within the image forming apparatus.

17. An image forming apparatus comprising:

a case having an opening at one side;

an accommodation cartridge for containing a recording medium; and a second cartridge, the second cartridge configured to engage the accommodation cartridge, the second cartridge comprising:

a feeding roller system for feeding the recording medium; and a belt unit engaging the feeding roller system, the belt unit comprising a conveying belt, the conveying belt for receiving the recording medium fed from the feeding roller system and for conveying the recording medium, wherein the accommodation cartridge and the second cartridge are configured to be removed through the opening while being engaged with one another, and wherein the conveying belt is configured to be removed from the belt unit when the second cartridge has been removed from the image forming apparatus.

18. The image forming apparatus according to claim 17, wherein the accommodation cartridge is configured to be detached from the second cartridge for removal through the opening while at least a portion of the second cartridge remains within the image forming apparatus.

* * * * *